US005745968A

United States Patent [19]

Genest et al.

[11] Patent Number: 5,745,968

[45] Date of Patent: May 5, 1998

[54] SOUND DAMPENING TOOL FOR CYLINDRICAL PRINTING BLANKETS

[75] Inventors: John H. Genest, Fort Mill; Andrew J. Gaworowski, Moore; Herman D. Sheron, Seneca, all of S.C.

[73] Assignee: Reeves Brothers, Inc., Spartanburg, S.C.

[21] Appl. No.: 711,766

[22] Filed: Sep. 10, 1996

[51] Int. Cl.[6] ..... B25B 27/00

[52] U.S. Cl. ..... 29/270; 29/271; 29/272; 29/278; 29/282

[58] Field of Search ..... 29/270, 272, 271, 29/278, 283, 282; 384/489

[56] References Cited

U.S. PATENT DOCUMENTS

| | | | |
|---|---|---|---|
| 704,421 | 7/1902 | Woodbury | 29/271 |
| 1,808,913 | 6/1931 | Wilson, Jr. | 29/271 |
| 1,875,097 | 8/1932 | Mitchell | 384/489 |
| 2,430,201 | 11/1947 | Wyscaver | 29/282 |
| 2,434,660 | 1/1948 | Knight | 29/270 |
| 3,331,638 | 7/1967 | Fruth | 384/489 |
| 4,378,136 | 3/1983 | Suzuki | 384/489 |
| 4,913,048 | 4/1990 | Tittgemeyer . | |
| 5,205,213 | 4/1993 | Bresson . | |
| 5,304,267 | 4/1994 | Vrotacoe et al. . | |
| 5,316,798 | 5/1994 | Tittgemeyer . | |

*Primary Examiner*—James G. Smith
*Assistant Examiner*—Lee Wilson
*Attorney, Agent, or Firm*—Pennie & Edmonds

[57] ABSTRACT

The present invention relates to a tool used to insert the sleeve of a cylindrical printing blanket over a press cylinder. One end of the tool is equipped with a tapered portion which forms a snug fit with the inside wall of the sleeve. This tapered portion is formed on a ring shaped member, a plurality of connecting rods connect the ring shaped member to a base plate attached to a handle. The length of these connecting rods is sufficient to accommodate the length of a bearing assembly of the press cylinder onto which the cylindrical blanket is mounted.

12 Claims, 2 Drawing Sheets

SOUND DAMPENING TOOL FOR CYLINDRICAL PRINTING BLANKETS

TECHNICAL FIELD

The present invention relates to a mechanical device for use in handling a cylindrical printing blanket for in offset printing. More particularly, it concerns a tool used for mounting or removing a printing blanket onto or from a printing press cylinder.

BACKGROUND ART

A cylindrical printing blanket consists of a thin metal sleeve on which layers of rubber and reinforcing material are built. To use a cylindrical printing blanket, one must mount it upon a press cylinder. Usually, mounting is done by sliding the cylindrical printing blanket over one end of the press cylinder. During this process, the cylindrical printing blanket is expanded by compressed air supplied by holes fitted to the cylinder. The compressed air pushes outward on the cylindrical printing blanket, allowing the expanded blanket to slide over the cylinder with reduced friction.

As the cylindrical printing blanket is applied over the end of the press cylinder, the free end of the sleeve gets shorter. As it gets shorter, vibration produces loud, high pitch noises which are hazardous to a press operator's hearing. This mandates the use of hearing protection which reduces the ability of the operator to hear instructions or other necessary information.

To reduce the level of noise, a dampening pad is normally attached to the cylindrical printing blanket. The pad is usually made of a metal strip and is mounted on the inside end of the sleeve by means of double face adhesive tape. The dampening pad and the labor required to install the dampening pad add to the cost of using a printing apparatus.

In use, the dampening pads occasionally fall off the blanket as a result of exposure to ink, water and blanket wash-up solvents. This is because the blankets are often taken off the press and then re-installed later. These re-used blankets frequently lose their pads after repeated use.

A further disadvantage with using noise dampening pads is that the pads may fall off while the press is running. In such situations, expensive damage can be caused to the press. This is in addition to the expensive down time associated with such problems.

SUMMARY OF THE INVENTION

The present invention eliminates the need for sound dampening pads in cylindrical printing blankets by providing a tool which can be used to install a cylindrical printing blanket onto the press cylinder. The tool is formed at one end with a fitting member having a surface adapted to form a frictional fit with the inner surface of the cylindrical sleeve of the printing blanket. The fitting member is attached to a ring member having an outer diameter greater than the inner diameter of the sleeve. The ring member is large enough to pass over the bearing assembly. A manipulation member connected to the ring member facilitates insertion of the fitting member into the sleeve without interfering with the bearing assembly of the printing press cylinder.

The invention further comprises additional features. One of these is that the fitting member is provided with a tapered end to form a snug fit against the inner wall of the sleeve. Another is that the ring member is connected to a mounting plate by tubular extension members resulting in the ring member being spaced apart from the mounting plate by a distance at least as long as the bearing assembly.

DETAILED DESCRIPTION OF THE PREFERRED EMBODIMENT

Figure 1:
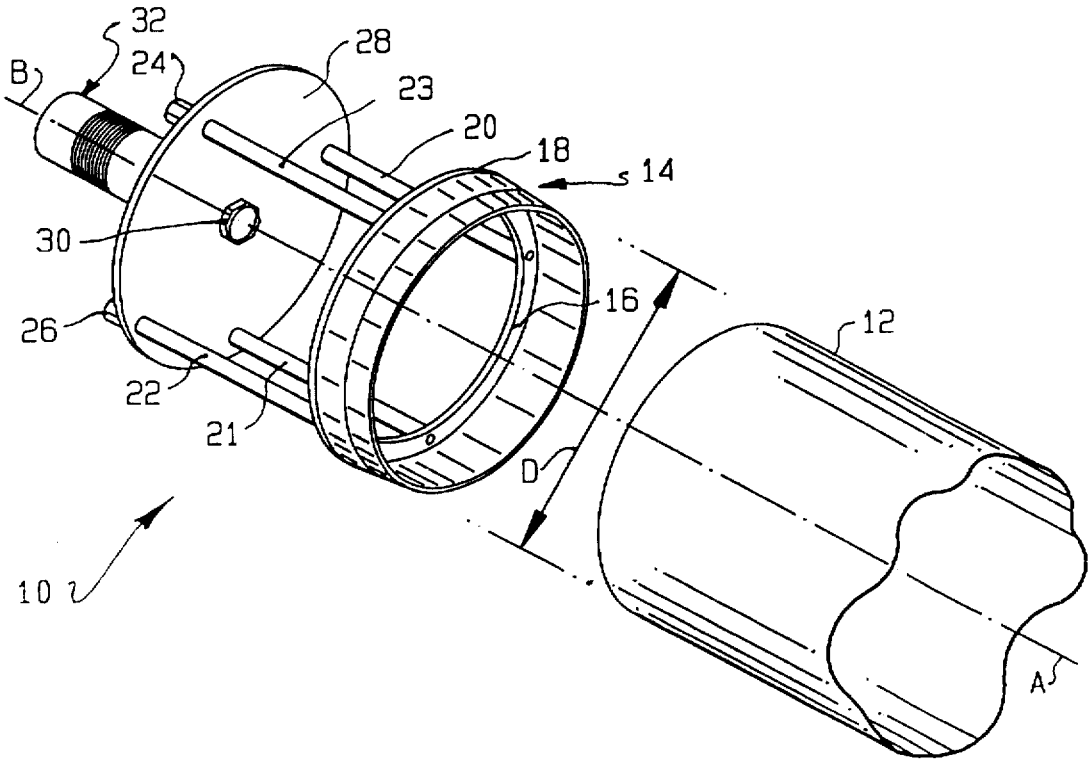
FIG. 1 is a perspective view of the sound dampening tool of the present invention.

Referring to FIG. 1, the tool of the present invention is shown generally as 10. The tool 10 is inserted into a sleeve 12 of a cylindrical printing blanket having an internal diameter D. One end of the tool is provided with a circumferential fitting member 14 which guides the tool into the sleeve 12 and fits snugly into the inner diameter of the metal sleeve 12.

Figure 3:
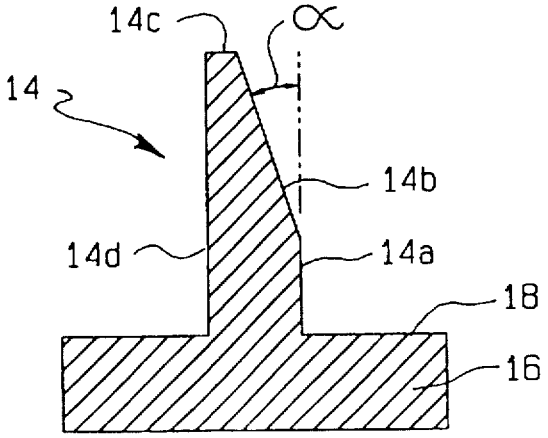
FIG. 3 shows a cross-section of the fitting member of the tool of FIG. 1.

As shown in FIG. 3, the fitting member 14 preferably has a wedge-shaped cross-section defined by an axial outer wall **14*a*, an angled outer wall 14*b*, a blunt end 14*c* and an axial inner wall 14*d*. The angled outer wall is angled with respect to the axial outer wall by an angle $\alpha$. In the preferred embodiment, $\alpha$ is between 15°–45°, and is most preferably 30°. The angled outer wall 14*b* helps guide the tool into the sleeve. After the foremost portion of the fitting member has been guided into the sleeve, the tool is pushed further into the sleeve until the axial outer wall 14*a* forms a tight fit with the inner wall of the sleeve 12**.

The base of the fitting member 14 is attached to a circular muffler ring 16 which has an inner diameter smaller than that of the fitting member 14. In the preferred embodiment, the fitting member 14 and the muffler ring 16 are integrally formed. This, however, is not an absolute requirement and so a separate fitting member may be fastened to a muffler ring by welding, bolting, adhesives, and other conventional means known to those skilled in the art.

The muffler ring 16 has an outer diameter which is greater than that of the fitting member 14 and forms a lip portion 18 which abuts the end wall of the sleeve 12 when the fitting member is fully inserted into the sleeve 12. This prevents the tool from being inserted too far into the sleeve itself. Thus, the lip 18 serves as a stop for the sleeve 12 when the ring 16 is fully inserted. The lip 18 and the fitting member 14 help prevent the passage of air and the generation of high pitch noise. This prevents high pitch noise from being generated when the blanket is mounted onto the cylinder. When the fitting member 14 contacts the inner diameter of the sleeve 12, air is prevented from passing between the fitting member 14 and the sleeve 12.

Figure 2:
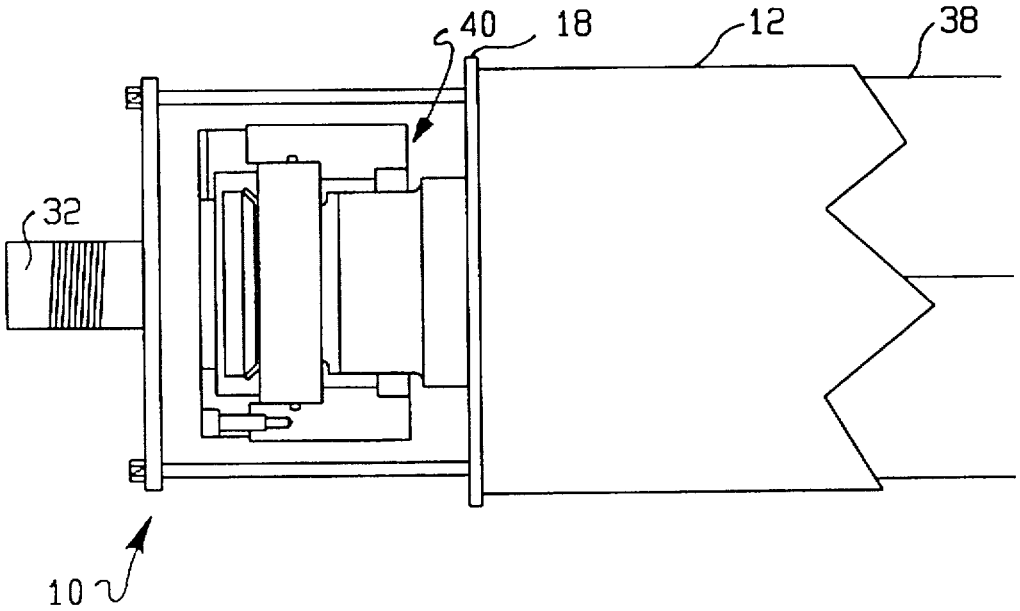
FIG. 2 shows the tool of FIG. 1 being used to place a metal sleeve over a press cylinder.

Affixed to the ring 16 are four spacer tubes 20–23, as shown in FIG. 1. As best shown in FIG. 2, the length of the spacer tubes and the size of the muffler ring 16 depend on the size of the bearing assembly 40 of the press cylinder 38. The preferred embodiment is suitable for use with the Heidelberg-Harris™ M-3000 press, which is one industry standard. The M-3000 has a bearing assembly with an outer diameter of about 5 ⅛"and a clearance length of about 4 ¾". Thus the tool's ring 16 must have an inner diameter slightly greater than the first stated dimension and the tubes 20–23 must have a length slightly greater that the second.

The other ends of the spacer tubes are fixed to a disk-shaped support plate 28 using fasteners 24, 26, respectively, which may include a threaded rod with end nuts. Other fastening means can be used, including welding or adhesives, depending upon the materials used for the spacer tubes 20, ring 16, and support plate 28. FIG. 1 shows four spacer tubes, but any number, such as two, three, five, six or more, of spacer tubes may be used instead. Also, other structures separating the muffler ring from the support plate 28 may be used, such as a cylindrical extension having substantially the same diameter as the muffler ring 16 or fitting member 14. In such case, the cylindrical extension may have windows or cut-outs through which one can view the bearing assembly.

The support plate 28 is fixed to a handle 32 by means of a handle bolt 30, typically a threaded rod with end nuts. Again, other fastening means such as welding, adhesives or the like can be used depending upon the materials of the handle 32 and support plate 28. The handle 32 is provided with a textured portion to provide a better grip. The handle facilitates manipulation of the blanket and its placement on the printing cylinder.

As shown in FIG. 1, the entire tool has a longitudinal axis B. Longitudinal axis B is aligned with longitudinal axis A of the sleeve as the tool is inserted into the sleeve.

As shown in FIG. 2, sleeve 12, into which the tool 10 has been fitted, is placed over the bearing assembly 40 and then over the press cylinder 38. As is evident from FIGS. 1 and 2, the fitting member 14, once fitted into metal sleeve 12, prevents the latter from excessive vibration and from allowing air to pass between the fitting member 14 and the sleeve. This reduces the noise associated with applying the sleeve over the press cylinder 38.

In the preferred embodiment, the tool is constructed using steel and aluminum components. Other common metals could also be used for its construction. For instance, the tool could be made from industrial plastics, either molded or machined. A tool constructed from molded industrial plastic is particularly well suited for volume production. A wooden handle or elastomeric handle may be desirable for certain applications.

A number of variations are possible with the present invention. For instance, as described above, the spacer tubes 20–23 can be replaced with a cylindrical member. Almost any structure which leaves a separation between the muffler ring 16 and the support plate 28 will suffice.

Similarly, the fitting member 14 can be replaced by any mechanism that provides a snug fit between tool and the inner wall of the sleeve 12. For instance, instead of being circumferential in shape, the fitting member can be comprised of spaced apart resilient fingers which extend principally in an axial direction. As the tool is inserted into the sleeve 12, these fingers will then slightly bend inward towards the sleeve's longitudinal axis. The resilient fingers then provide an outward force against the inner surface of the sleeve, securing the latter.

Furthermore, the fitting member can be coated with an elastomeric or organic material which easily conforms to the inner diameter of the sleeve and provides enhanced sealing to prevent air from passing between the sleeve and the tapered portion.

The present invention has been disclosed with reference to a preferred embodiment. However, as demonstrated above, one skilled in the art will recognize that certain variations can be made. The scope of the present invention is set forth in the claims described below.

What is claimed is:

1. A tool for applying a cylindrical printing blanket onto a printing press cylinder having a bearing assembly mounted on at least one end thereof, said tool comprising:

a cylindrical fitting member having a first surface adapted to form a frictional fit with the inner surface of a cylindrical printing blanket sleeve;

a ring member attached to said cylindrical fitting member at one end thereof, said ring member having front and rear surfaces and an outer diameter which is greater than the outer diameter of said cylindrical fitting member; and a manipulation member operatively associated with said ring member for engaging said cylindrical fitting member with said sleeve without interfering with the bearing assembly of the printing press cylinder.

2. The tool of claim 1, wherein the first surface comprises a first outer wall adapted to form a frictional fit with the inner surface of the sleeve, said first outer surface retarding movement of air between the cylindrical fitting member and the sleeve.

3. The tool of claim 2 wherein the cylindrical fitting member further comprises an angled second outer wall adjacent to said first outer wall and being adapted to guide the tool into the sleeve.

4. The tool of claim 2, wherein the ring member is cylindrical and has an inner diameter which is smaller than the inner diameter of the cylindrical fitting member, and the manipulation member is mounted on the rear surface of the ring member.

5. The tool of claim 1, wherein the manipulation member includes a mounting plate, a handle attached to the mounting plate and extension members for spacing the mounting plate away from the ring member.

6. The tool of claim 5 wherein at least two extension members are utilized, each extension member connecting the mounting plate to the ring member.

7. The tool of claim 1 wherein the first surface of the cylindrical fitting member includes a coating thereon.

8. A tool for applying a cylindrical printing blanket onto a printing press cylinder having a bearing assembly mounted on at least one end thereof, said tool comprising:

a cylindrical fitting member having a first surface adapted to form a frictional fit with the inner surface of a cylindrical printing blanket sleeve;

a ring member attached to said cylindrical fitting member at one end thereof, said ring member having front and rear surfaces and an outer diameter which is greater than the outer diameter of said cylindrical fitting member; and a manipulation member operatively associated with said ring member for engaging said fitting member with said sleeve without interfering with the bearing assembly of the printing press cylinder, wherein the manipulation member includes a mounting plate, a handle and four extension members for spacing the mounting plate away from the ring member, said extension members comprising tubular members spaced equidistantly about a periphery of the ring member.

9. The tool of claim 8 wherein the handle is centrally mounted upon the mounting plate.

10. A tool comprising:

a ring member having a first side, a second side and a central axis;

a circumferential fitting member having a first end fixed to said first side of said ring member and a second end provided with a taper;

a plurality of extension members, each of said extension members having a first end and a second end, said first ends fixed to said second side of said ring member, said extension members extending parallel to said central axis in a direction away from said circumferential fitting member;

a support disk connected to said second ends of said extension members; and handle means attached to said support disk.

11. The tool of claim 10 wherein four extension members are utilized, said extension members comprising tubular members spaced equidistantly about a periphery of the ring member.

12. The tool of claim 10 wherein the handle is centrally mounted upon the support disk.

* * * * *